United States Patent [19]

Herron

[11] Patent Number: 4,758,177

[45] Date of Patent: Jul. 19, 1988

[54] ELECTRICAL TEST PROBE

[75] Inventor: Jeffrey W. Herron, Hurst, Tex.

[73] Assignee: Williams Instruments, Inc., Fort Worth, Tex.

[21] Appl. No.: 13,567

[22] Filed: Feb. 11, 1987

[51] Int. Cl.[4] ..... H01R 13/62; H01R 13/64

[52] U.S. Cl. ..... 439/348; 439/374

[58] Field of Search ..... 439/347, 348, 374

[56] References Cited

U.S. PATENT DOCUMENTS

| | | | |
|---|---|---|---|
| Re. 28,328 | 2/1975 | Williams | 439/352 |
| 3,505,635 | 4/1970 | Williams | 439/348 |
| 4,525,016 | 6/1985 | Williams | 439/296 |

*Primary Examiner*—Gil Weidenfeld
*Assistant Examiner*—Gary F. Paumen

[57] ABSTRACT

The test probe has a tubular body member with a fixed sleeve secured to its front end such that an annular space is formed between the tubular body member and the fixed sleeve rearward of the forward portion of the test probe. A plurality of forward apertures are formed through the fixed sleeve in a plane transverse to the axis of the tubular body member and a plurality of rearward apertures are formed through the fixed sleeve in a second plane transverse to the axis of the tubular body member. A slideable sleeve is located around the tubular body member and is adapted to be moved to rearward and forward positions in the annular space relative to the tubular body member. Centering balls are located partially in the forward apertures and partially in the annular space and latching balls are located partially in the rearward apertures and partially in the annular space. The moveable sleeve may be moved forward to initially move the centering balls outward through their apertures and then to move the latching balls outward through their apertures to center the probe in an opening of an apparatus having a reduced entrance and then to latch the probe in the opening apparatus. After testing is carried out, the moveable sleeve may be moved rearward to allow the centering and latching balls to be moved inward to allow the probe to be removed from the opening of the apparatus.

15 Claims, 2 Drawing Sheets

21

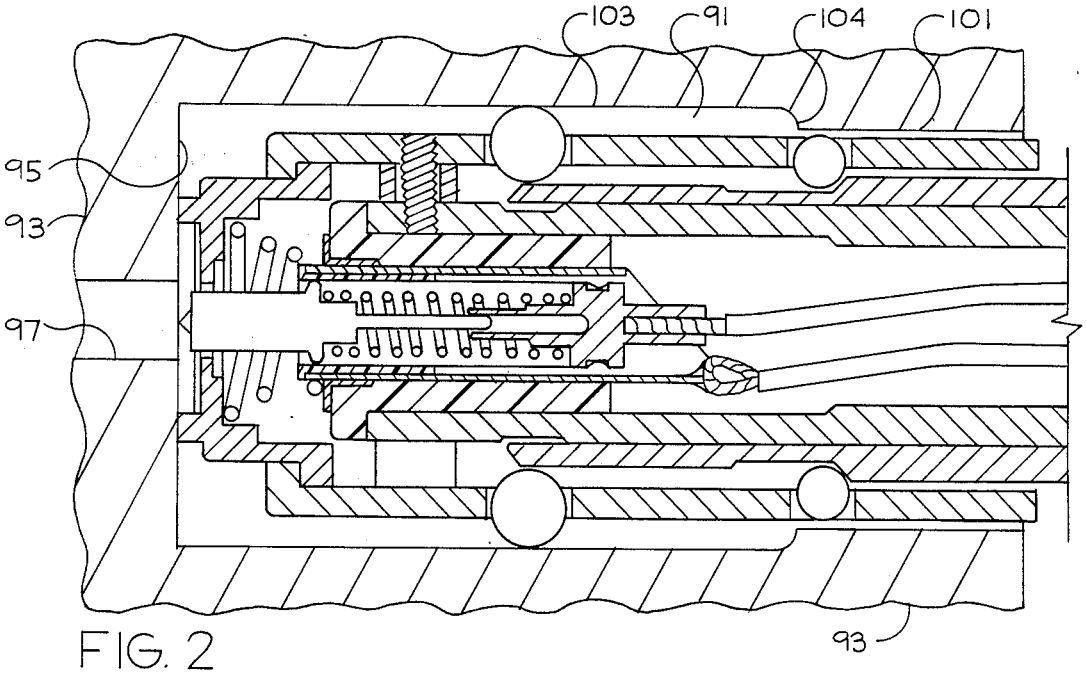
FIG. 2
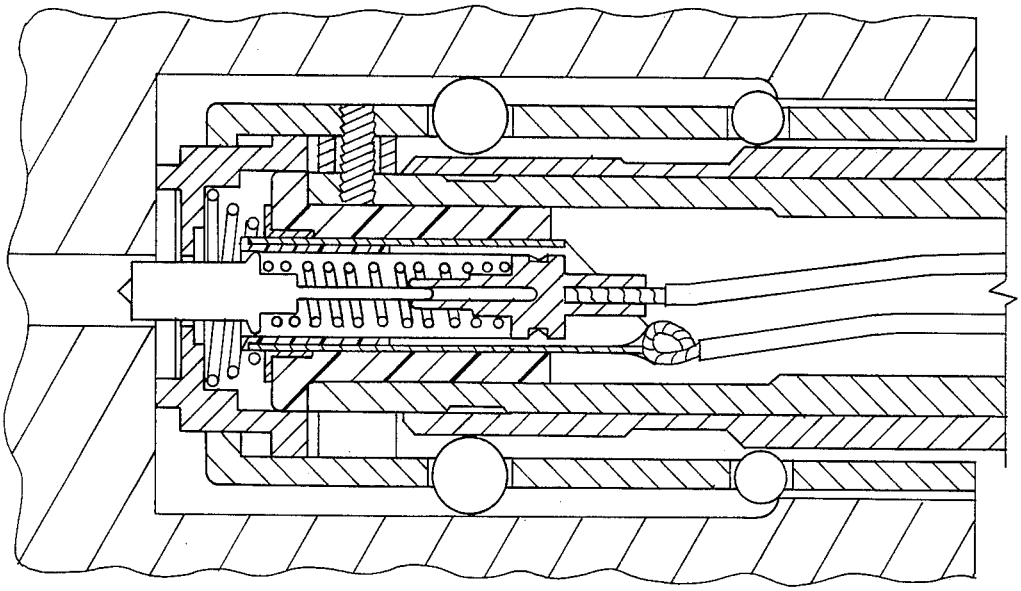
FIG. 3
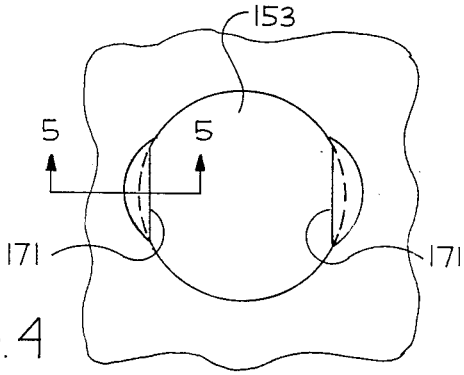
FIG. 4
FIG. 5
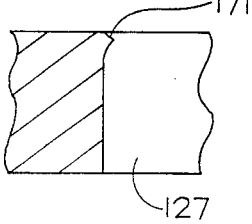

ELECTRICAL TEST PROBE

BACKGROUND OF THE INVENTION

U.S. Pat. Nos. 3,505,635, Re. 28,328, and 4,525,016, disclose electrical test probes of the type having a pair of electrical contacts at its forward end, a tubular body member and a movable sleeve located around the tubular body member. The sleeve is movable between rearward and forward positions relative to the tubular body member to cause latch means to be moved to latching and unlatching positions. The purpose of the latch means is to latch the probe inside of a well or opening of an aircraft to test the electrical circuit employed for firing an explosive charge carried by a cartridge.

Some wells or openings now in use which support the cartridges have reduced diameter entrances. This makes the testing more difficult since the test probe must be centered in the opening in order to make proper electrical engagement between the electrical contacts of the probe and of the circuit to be tested.

SUMMARY OF THE INVENTION

It is an object of the invention to provide a test probe with centering means and latching means such that it can be located in an opening of an apparatus through a reduced entrance and centered and latched in the opening to allow effective electrical testing to be carried out.

It is a further object of the invention to provide a test probe wherein the centering means are actuated before the latching means.

The test probe comprises a tubular member having a front end and a rear end with structure including electrical contact means supported at the front end thereof. A first sleeve is located around a forward portion of the tubular member and has a front portion attached to a front portion of the tubular member such that a rearward extending annular space is formed between the exterior of the tubular member and the interior of said first sleeve. A second sleeve is slideably located around the tubular member for sliding movement between rearward and forward positions relative to the tubular member. The second sleeve has a front end and a rear end with a forward portion adapted to slide within said annular space when said second sleeve is slid between its rearward and forward positions. A plurality of spaced apart forward apertures and a plurality of spaced apart rearward apertures are formed through said first sleeve in forward and rearward planes respectively transverse to the axis of the tubular member. Slot means are formed in the exterior of said second sleeve rearward of its front end and is located in the plane of said rearward apertures when said second sleeve is in its rearward position. A plurality of centering means are located partially in said forward apertures of said first sleeve and partially in the annular space. The centering means are adapted to be moved by said second sleeve outward through said forward apertures a given distance beyond the exterior of said first sleeve when said second sleeve is moved from said rearward position to said forward position for centering the test probe in the opening of the apparatus. A plurality of latching means are located partially in said rearward apertures of said first sleeve and partially in the annular space. The latching means are adapted to be moved by said second sleeve outward through said rearward apertures a given distance beyond the exterior of said first sleeve for engaging an inward extending wall of the opening of the apparatus for latching purposes when said second sleeve is moved to said forward position.

In a further aspect, the front end of said second sleeve engages and moves the centering means outward through said forward apertures of said first sleeve when said second sleeve is moved from said rearward position to said forward position. The structure of said second sleeve forming said slot means has a forward facing surface which engages and moves the latching means outward through said rearward apertures of said first sleeve when said second sleeve is moved from said rearward position to said forward position.

Preferably said slot means is located and has a dimension along the length of said second sleeve such that the front end of said second sleeve will engage and move the centering means outward through said forward apertures of said first sleeve before said forward facing surface of said second sleeve engages and moves the latching means outward through said rearward apertures of said first sleeve when said second sleeve is moved from said rearward position to said forward position.

In the embodiment disclosed, the forward apertures are larger than the rearward apertures and the centering means and the latching means comprises spheres with the spheres of the centering means being larger than the spheres of the latching means.

BRIEF DESCRIPTION OF THE DRAWINGS

FIG. 2 is a cross-sectional view of the forward portion of the test probe in an opening of an apparatus with its slideable sleeve in intermediate position between its rearward and forward positions urging its centering balls outward.

FIG. 3 is a cross-sectional view of a forward position of the test probe in an opening of an apparatus with its slideable sleeve in its forward position urging its centering balls and its latching balls outward.

FIG. 4 is a plan view of the entrance of one of the apertures formed through the outer fixed sleeve of the test probe.

FIG. 5 is a cross-sectional view of FIG. 4 as seen along the lines 5—5 thereof.

DESCRIPTION OF THE PREFERRED EMBODIMENT

Figure 1:
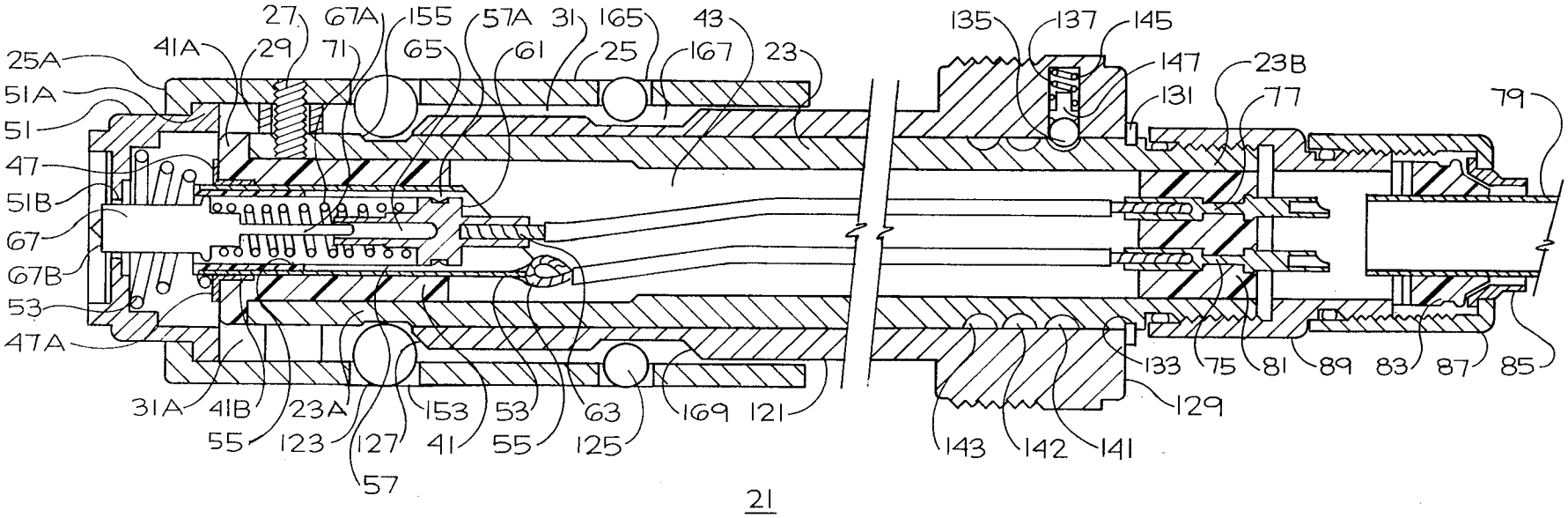
FIG. 1 is a cross-sectional view of the test probe of the invention taken through the length thereof and with its slideable sleeve in its rearward position.

Referring to the drawings the test probe of the invention is identified at 21. It comprises a hollow cylindrical shaped body member 23 having a front end 23A and a rear end 23B. A hollow cylindrical shaped outer sleeve 25 is located around the forward portion of member 23 and has its front portion attached to the front portion of member 23 by way of a plurality of set screws 27 and spacers 29. An annular space 31 is formed between fixed sleeve 25 and member 23 rearward of the spacers 29. Member 23 and sleeve 25 are formed of metal.

A hollow tubular insert 41 formed of a suitable electrically insulating plastic material is located in the front end of the cavity 43 of the member 23. The insert 41 has a radially extending flange 41A at its front end which seats against the front edge of member 23. A hollow metallic tubular member 47 is located in the front end of an enlarged diameter portion 41B at the front end of the insert 41. Member 47 has a radially extending flange 47A at its front end which seats against the front edge of the insert 41.

An annular electrical contact member 51 formed of metal, is provided at the front end of the probe 21 for forward and rearward movement. The rear portion of the contact 51 is located for rearward and forward movement in the annular space 31A between member 23 and sleeve 25 forward of the spacers 29. The front end of the fixed sleeve 25 has an inward extending wall 25A for engaging an outward extending wall 51A of the contact 51 at its rear end for limiting forward movement of the contact 51. A metallic coiled spring 53 located against the inside wall of the contact 51 and against the flange 47A of member 47 urges the contact 51 outward and provides an electrical connection between the contact 51 and member 47. Member 47 makes electrical contact with a metallic tubular member 53 located in the opening of the insert 41 to which an electrical lead 55 is connected.

Secured within the tubular member 53 is an electrical insulating member 55 which engages and holds a thin metal tubular member 57. The rear end of member 57 has metallic member 61 located and secured therein by crimping the thin wall of the tubular member 57 to member 61 as shown at 57A. The rear end of member 61 is connected to an electrical lead 63 and the other end has an aperture 65 for slideably receiving the pin-like rear end 67A of a central contact 67. The forward end 67B of the contact 67 extends through the central aperture 51B of the annular contact 51 without engagement thereof. A coiled metallic spring 71 has its front end tightly located around an intermediate portion 67C of the contact 67 and its rear end engaging a forward facing wall of member 61 inside of tubular members 55 and 57. Coil 71 urges contact 67 in a forward position and provides electrical connection between contact 67 and member 61. Leads 55 and 63 are connected to electrical connecting members 75 and 77 which are adapted to be connected to leads (not shown) which extend rearward from the probe 21 by way of tubular member 79. Members 75 and 77 are held in place by an electrically insulating member 81 of suitable plastic. Tubular member 79 is held in place by an annular plastic member 83, annular member 85, sleeve 87 screwed to the rear end of sleeve 89 which is screwed to the rear end of tubular member 23.

In using the test probe, its forward end is inserted into the opening or well 91 formed in metal structure 93 of an aircraft such that its annular contact 51 engages the back wall 95 of the opening 91 and its central contact 67 is centered relative to an aperture 97 for engaging an electrical contact (not shown) of circuity of the aircraft to be tested. The wall 101 of the opening 91 forming the entrance is of a smaller diameter than the diameter of the wall 103 forming the major portion of the opening 91.

In order to make effective electrical engagement with the circuit contact in the aperture 97 and to effectively test the circuit, the probe 21 must be centered and latched within the opening 91. The test probe of the invention comprises a movable sleeve 121 located around the member 23, centering balls 123, and latching balls 125 for centering and latching the probe in the opening 91. The sleeve 121 has a front end 127 and a rear end 129 and can be slid on the member 23 between rearward, intermediate, and forward positions as shown in FIGS. 1, 2, and 3 respectively. A split washer 131 located in a slot 133 at the rear end of tubular member 23 limits rearward movement of the sleeve 121 and spacers 29 limit its forward movement. A spring biased ball 135 located in aperture 137 formed in the rear end of the sleeve 121 is adapted to be releasably located in either of annular slots 141, 142, or 143 formed in the outer wall at the rear of member 23 for releasably holding the sleeve 121 in its rearward, intermediate, or forward positions respectively relative to member 23. Ball 135 is urged inward of the sleeve 121 by a coil spring 145 and an engaging member 147.

The centering balls 123 are located partially in apertures 153 formed through the fixed sleeve 25 in a plane transverse to the axis of member 23 and partially in the annular space 31. An annular slot 155 is formed in the outer wall of member 23 such that the balls 123 can be located flush or nearly flush with the outer wall of fixed sleeve 25 when the movable sleeve 121 is located in its rearward position.

Means is provided for preventing the centering balls 123 from passing completely outward through the apertures 153 as will be discussed subsequently with reference to FIGS. 4 and 5.

The latching balls 125 are located partially in apertures 165 formed through the fixed sleeve 25 in a plane transverse to the axis of member 23 partially and in the annular space 31. An annular slot 167 is formed in the outer wall of movable sleeve 121 such that the slot 167 will be in the plane of the balls 125 when the sleeve 121 is located in its rearward and intermediate positions. The slot 167 allows the balls 125 to be located flush or nearly flush with the outer wall of the fixed sleeve 25 when the movable sleeve 121 is located in its rearward and intermediate positions. The movable sleeve 121 has a forward facing edge 169 which extends rearward at an angle from the rear end of the slot 167. Means are provided for preventing balls 125 from passing completely through the apertures 165 as will be described subsequently with reference to FIGS. 4 and 5.

In using the test probe, the sleeve 121 is moved to its rearward position such that the balls 123 and 125 may be located flush with the outer wall of the fixed sleeve 25 allowing the probe to be inserted through the reduced entrance 101 of the apparatus until the annular contact 51 engages the rear wall 95 of the opening. The sleeve 121 then is moved forward to its intermediate position relative to the member 23. This causes the centering balls 123 to ride outward on the slanted edge 127 of the sleeve 121 whereby the front portion of the sleeve 121 may be located between the centering balls 123 and the fixed sleeve 25 thereby causing the centering balls 123 to move radially outward through their apertures 153 as shown in FIG. 2 to engage the enlarged portion 103 of the opening 91 to center the probe in the opening. In this position of the sleeve 121, the latching balls 125 are still in their inward positions. The tubular member 23 and fixed sleeve 25 of the probe can then be moved forward, compressing the spring 53, until the apertures 165 are forward of the edge 104 of the opening 91 between the entrance and the enlarged portion 103. The movable sleeve 121 then can be moved forward to its forward position. As it moves forward, the latching balls 125 move outward on the rearward slanted edge 129 of the slot 167 until the sleeve 121 rearward of the slot 167 is between the latching balls 125 and the fixed sleeve 25. This causes the latching balls 125 to move radially outward whereby they may engage the edge 104 of the opening 91 as shown in FIG. 3 thereby latching the probe in the opening 91. Although not shown, the forward end 67B of the contact 67 will engage a contact in aperture 97 whereby spring 71 also will be compressed as the tubular member 23 and the fixed sleeve 25 are moved forward to engage the latching balls 125 with the edge 104. After testing is carried out, the sleeve 121 can be moved to its rearward position allowing the centering and latching balls to move inward relative to the sleeve 25 thereby allowing the test probe to be removed from the opening 91.

The outer surface of the fixed sleeve 25 on opposite sides of each of the apertures 153 and 165 is swedged inward a slight amount to form two small inwardly extending ridges on opposite sides of each of the apertures 153 and 165 near their outer openings to prevent their balls from passing completely through the apertures. Two such ridges 171 are shown in FIGS. 4 and 5 of one of the apertures 153. These ridges allow the ball to move outward through the aperture but limit its outward movement. Similar ridges are formed for all of the apertures 153 and 165.

Thus, in the preferred embodiment, the centering balls 123 are moved outward for centering purposes and then the latching balls 125 are moved outward for latching purposes as the sleeve 121 is moved from its rearward position to its intermediate and then to its forward positions.

All of the apertures 153 are of the same size and all of the centering balls 123 are of the same size. In addition, all of the apertures 165 are of the same size and all of the latching balls 125 are of the same size. In one embodiment, the test probe has six centering balls 123 and six latching balls 125. Each of the balls 123 and 125 is formed of a suitable metal and is in the shape of a sphere. The diameters of the balls 123 are greater than the diameters of the balls 125.

I claim:

1. A test probe to be inserted into an opening of an apparatus to test an electrical circuit, comprising:

a tubular member having a front end and a rear end, structure including electrical contact means supported at the front end of said tubular member, a first sleeve located around a forward portion of said tubular member, said first sleeve having a front portion attached to a front portion of said tubular member such that an annular space is formed between the exterior of said tubular member and the interior of said first sleeve rearward of said front portions of said first sleeve and of said tubular member, a second sleeve slideably located around said tubular member for sliding movement between rearward and forward positions relative to said tubular member, said second sleeve having a front end and a rear end with a forward portion adapted to slide within said annular space when said second sleeve is slid between said rearward and forward positions, respectively, a plurality of spaced apart forward apertures formed through said first sleeve in a plane transverse to the axis of said tubular member, a plurality of spaced apart rearward apertures formed through said first sleeve in a plane transverse to the axis of said tubular member, slot means formed in the exterior of said second sleeve rearward of its front end, said slot means being located in the plane of said rearward apertures when said second sleeve is in its rearward position, a plurality of centering means located partially in said forward apertures respectively of said first sleeve and partially in said annular space, said plurality of centering means being adapted to be moved by said second sleeve outward through said forward apertures a given distance beyond the exterior of said first sleeve when said second sleeve is moved from said rearward position to said forward position for centering the test probe in the opening of the apparatus, a plurality of latching means located partially in said rearward apertures respectively of said first sleeve and partially in said annular space, said plurality of latching means being adapted to be moved by said second sleeve outward through said rearward apertures a given distance beyond the exterior of said first sleeve for engaging an inward extending wall in the opening of the apparatus for latching purposes when said second sleeve is moved to said forward position.

2. The test probe of claim 1, wherein:

when said second sleeve is in its rearward position, said plurality of centering means are held in place by the structure of said first sleeve forming said forward apertures respectively and the exterior of said tubular member and said plurality of latching means are held in place by the structure of said first sleeve forming said forward apertures respectively and the structure of said second sleeve forming said slot means.

3. The test probe of claim 1, wherein:

said plurality of centering means comprise spheres and said plurality of latching means comprise spheres.

4. The test probe of claim 2, wherein:

said forward apertures are larger than said rearward apertures, said centering means are larger than said latching means.

5. The test probe of claim 2, wherein:

said plurality of centering means comprise spheres and said plurality of latching means comprise spheres.

6. The test probe of claim 2, wherein:

said forward apertures are larger than said rearward apertures, said plurality of centering means comprise spheres each having a first diameter and said plurality of latching means comprise spheres each having a second diameter, said first diameter being greater than said second diameter.

7. The test probe of claim 2, wherein:

the front end of said second sleeve engages and moves said plurality of centering means outward through said forward apertures of said first sleeve when said second sleeve is moved from said rearward position to said forward position, the structure of said second sleeve forming said slot means has a forward facing surface which engages and moves said plurality of latching means outward through said rearward apertures of said first sleeve when said second sleeve is moved from said rearward position to said forward position.

8. The test probe of claim 7, wherein:

said forward apertures are larger than said rearward apertures, said centering means are larger than said latching means.

9. The test probe of claim 7, wherein:

said plurality of centering means comprise spheres and said plurality of latching means comprise spheres.

10. The test probe of claim 7, wherein:

said forward apertures are larger than said rearward apertures, said plurality of centering means comprise spheres each having a first diameter and said plurality of latching means comprise spheres each having a second diameter, said first diameter being greater than said second diameter.

11. The test probe of claim 7, wherein:

said slot means is located and has a dimension along the length of said second sleeve is such that said front end of said second sleeve will engage and move said plurality of centering means outward through said forward apertures of said first sleeve before said forward facing surface of said second sleeve engages and moves said plurality of latching means outward through said rearward apertures of said first sleeve when said second sleeve is moved from said rearward position to said forward position.

12. The test probe of claim 10, wherein:

said forward apertures are larger than said rearward apertures, said centering means are larger than said latching means.

13. The test probe of claim 10, wherein:

said plurality of centering means comprise spheres and said plurality of latching means comprise spheres.

14. The test probe of claim 10, wherein:

said forward apertures are larger than said rearward apertures, said plurality of centering means comprise spheres each having a first diameter and said plurality of latching means comprise spheres each having a second diameter, said first diameter being greater than said second diameter.

15. The test probe of claim 14, comprising:

rearward, intermediate, and forward spaced apart slot means formed in the exterior of the rearward portion of said tubular member along its length, and spring biased holding means supported by said second sleeve for removably entering said rearward, intermediate, and forward slot means when said second sleeve is moved to its rearward position, to an intermediate position and to its forward position respectively relative to said tubular member for releasably holding said second sleeve in said rearward, intermediate, and forward positions relative to said tubular member.

* * * * *